US006793877B1

(12) United States Patent
Pettersen et al.

(10) Patent No.: US 6,793,877 B1
(45) Date of Patent: Sep. 21, 2004

(54) CORROSION RESISTANT MG BASED ALLOY CONTAINING AL, SI, MN AND RE METALS

(75) Inventors: Ketil Pettersen, Porsgrunn (NO); Marianne Videm, Porsgrunn (NO); Jan Ivar Skar, Stathelle (NO)

(73) Assignee: Norsk Hydro ASA, Olso (NO)

( * ) Notice: Subject to any disclaimer, the term of this patent is extended or adjusted under 35 U.S.C. 154(b) by 0 days.

(21) Appl. No.: 10/019,431

(22) PCT Filed: Oct. 25, 1999

(86) PCT No.: PCT/NO99/00324

§ 371 (c)(1),
(2), (4) Date: May 20, 2002

(87) PCT Pub. No.: WO01/02614

PCT Pub. Date: Jan. 11, 2001

(30) Foreign Application Priority Data

Jul. 2, 1999 (NO) ..... 19993289

(51) Int. Cl.[7] ..... C22C 23/02
(52) U.S. Cl. ..... 420/407; 420/408; 420/409
(58) Field of Search ..... 420/407, 408, 420/409

(56) References Cited

U.S. PATENT DOCUMENTS

| | | | | | |
|---|---|---|---|---|---|
| 3,718,460 A | | 2/1973 | Foerster | | |
| 5,059,390 A | * | 10/1991 | Burleigh et al. | ..... | 420/405 |
| 5,073,207 A | * | 12/1991 | Faure et al. | ..... | 148/2 |
| 5,078,962 A | * | 1/1992 | Regazzoni et al. | ..... | 420/402 |
| 5,326,528 A | | 7/1994 | Makino | | |
| 5,336,466 A | * | 8/1994 | Iba et al. | ..... | 420/406 |
| 5,552,110 A | * | 9/1996 | Iba et al. | ..... | 420/406 |

FOREIGN PATENT DOCUMENTS

| | | | | |
|---|---|---|---|---|
| EP | 0 524 644 | | 1/1993 | |
| EP | 0 813 616 | | 12/1997 | |
| FR | 1555251 | | 1/1969 | |
| GB | 2051129 A | * | 1/1981 | ..... C22C/23/00 |
| JP | 0 524 644 A1 | * | 1/1993 | ..... C22C/23/00 |
| NO | 121753 | | 4/1971 | |
| SU | 336362 | | 5/1972 | |

* cited by examiner

*Primary Examiner*—Daniel Jenkins
(74) *Attorney, Agent, or Firm*—Wenderoth, Lind & Ponack, L.L.P.

(57) ABSTRACT

Magnesium alloy with improved corrosion resistance comprising magnesium, 1.5–5 weight % Al, 0.6–1.4 weight % Si, 0.01–0.6 weight % Mn and 0.01–0.4 weight % RE. Method of improving the corrosion resistance of magnesium, aluminium, silicon alloys where Mn is added in order to reduce FE impurities, by keeping both Mn and Fe at a low level by adding small amounts of RE.

8 Claims, 9 Drawing Sheets

CORROSION RESISTANT MG BASED ALLOY CONTAINING AL, SI, MN AND RE METALS

This application is a 371 application of PCT/NO99/00324 filed Oct. 25, 1999.

Such alloys are used for die casting of for example automotive, transmission and engine parts. Therefore the alloy needs to have good mechanical properties also at elevated temperatures. Alloys for this use available on the market today include AS21, AS41 and AE42. The alloy AS21 has the following composition (Hydro Magnesium Specifications), 1.9–2.5 weight % Al, minimum 0.2 weight % Mn, 0.15–0.25 weight % Zn, 0.7–1.2 weight % Si, maximum 0.008 weight % Cu, maximum 0.001 weight % Ni, maximum 0.004 weight % Fe and maximum 0.01 weight % of other elements each. The alloy AS41B (ASTM B93-94a) contains 3.7–4.8 weight % Al, 0.35–0.6 weight % Mn, maximum 0.10 weight % Zn, maximum 0.60–1.4 weight % Si, maximum 0.015 weight % Cu, maximum 0.001 weight % Ni, maximum 0.0035 weight % Fe and maximum 0.01 weight % of other elements each. The alloy AE42 (Hydro Magnesium Specifications) contains 3.6–4.4 weight % Al, minimum 0.1 weight % Mn, maximum 0.20 weight % Zn, maximum 0.04 weight % Cu, maximum 0.001 weight % Ni, maximum 0,004 weight % Fe, 2.0–3.0 weight % RE and maximum 0.01 weight % of others each. RE refers to rare earth elements. All these alloys contain some iron and as iron is detrimental to the corrosion properties of magnesium aluminium alloys, manganese is used to control and reduce the iron content in the alloys.

In spite of this, the corrosion resistance of for example AS21 is not sufficient in e.g. automotive use. Car parts are subjected to a harsh environment especially at winter time when de-icing agents are applied to the roads. The alloy AE42 has good corrosion properties also in this environment, but it is more expensive than e.g. AS21. In addition, the casting properties are not as good as for the others, particularly due to a tendency to stick and solder to the die.

Alloys of this type are also described for example in Norwegian patent No. 121 753, U.S. Pat. No. 3,718,460 and French patent No. 1 555 251.

The object of the invention is to improve the corrosion resistance without detoriation of basic properties of magnesium-aluminium-silicon alloys. Another object is to avoid increased costs of the alloy.

These and other objects of the invention are obtained by the alloy as described below. The invention is further described and characterized by the accompanying patent claims.

The invention concerns a magnesium based alloy with improved corrosion resistance, containing 1.5–5 weight % Al, 0.6–1.4 weight % Si, 0.01–0.6 weight % Mn, 0.01–0.4 weight % RE. The content of impurities should be kept at a low level with maximum 0.008 weight % Cu, maximum 0.001 weight % Ni, maximum 0.004 weight % Fe and maximum 0.01 weight % of other elements each. Particularly, a Mn content of 0.05–0.2 weight % is favorable. In addition, it is preferable to add until 0.5 weight % Zn and especially 0.1–0.3 weight % Zn. This element has a positive effect on corrosion resistance. The rare earth elements used are preferably in the form of Misch metal. A preferred alloy contains 1.9–2.5 weight % Al, 0.7–1.2 weight % Si, 0.15–0.25 weight % Zn, 0.01–0.3 weight % RE and 0.01–0.2 weight % Mn. The invention also concerns a method of improving the corrosion resistance of magnesium, aluminium, silicon alloys where Mn is added in order to reduce Fe impurities, by keeping both Mn and Fe at a low level by adding small amounts of RE. It is preferred to keep the Mn content above 0.01 weight % and the RE content in the range 0.01–0.4.

The invention will be further illustrated with reference to FIGS. 1–9, where FIG. 1 shows the combination of Mn and RE content found in the the investigated specimens. These compositions span the temperature range from 650° C.–720° C. The mutually limited solubility of Mn and RE restricts the investigation to the lower left half of the figure.

The present findings show that it is possible to significantly improve the corrosion resistance of magnesium alloys with aluminium and silicon by the addition of small amounts of Rare Earth (RE) elements. One or more of scandium, yttrium, lanthanum, cerium, praseodymium, neodymium, promethium, samarium, europium, gadolinium, terbium, dysprosium, holrium, erbium, thulium, ytterbium and lutetium may be used as rare earth elements. However, it is expensive to isolate the individual rare earth elements, so Misch metal, which is comparatively cheap, may preferably be used.

In Mg-Al-Si based alloys the solubilities of Mn, RE and Fe are mutually restricted. In addition, reduced temperature reduces their mutual solubility.

Several experiments have been carried out and are described in the following examples.

EXAMPLE 1

Figure 1:
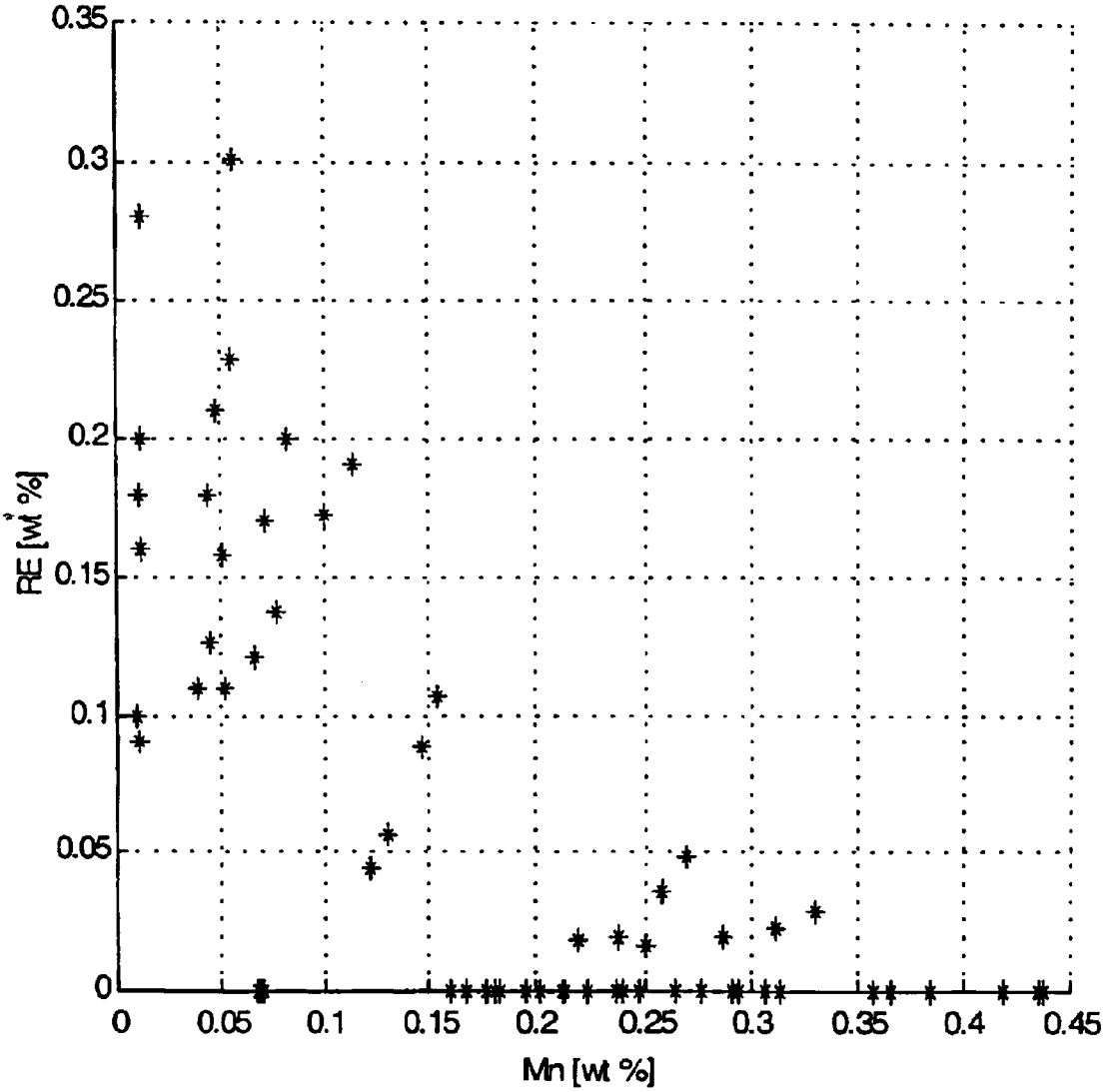

Magnesium alloys of the type AS21 have been prepared with different combinations of Mn and RE. Table 1 and FIG. 1 shows the different combinations of Mn and RE which are investigated. The Rare Earth elements are added in the form of Misch metal, a mixture of Ce, La Pr and Nd (Approx. 55 weight % Ce, 25 weight % La, 15 weight % Nd, 5 weight % Pr). Other mixtures of Rare Earth elements are expected to give the same effect.

The other elements Al, Si and Zn were held constant within the specification of the alloy, and close to 2.2%, 1.0% and 0.2% respectively. The alloys were prepared by adding controlled amounts of Mn and RE to the alloy at temperatures around 740° C. (for some compositions about 760° C.), and then giving the alloys time to stabilize at specified temperatures before casting of test samples for chemical analysis and corrosion tests. The Fe content of the specimens is a result of the equilibrium condition established.

In addition, unmodified AS21 was also tested and the results are included in Table 1.

The corrosion resistance was determined for gravity cast disc samples by immersing into a solution of 5% NaCl at 25°

C. for 72 hours. The ratio between test solution and sample surface was 10 ml/cm$^2$ in all the tests. The casting temperature and corrosion rate for gravity cast disc samples are included in Table 1. The corrosion rates are determined by weight loss measurements and are measured in MCD (mg/cm$^2$day).

TABLE 1

Casting temperature, composition and corrosion rates for the permanent mold cast medallions included in this investigation.

| Temp. [° C.] | Al [weight %] | Zn [weight %] | Mn [weight %] | Si [weight %] | Fe [ppm] | RE [weight %] | Corrosion rate [MCD] |
|---|---|---|---|---|---|---|---|
| 650 | 2.42 | 0.19 | 0.00 | 0.96 | 12 | 0.10 | 4.9 |
| 650 | 2.18 | 0.19 | 0.16 | 0.99 | 21 | 0.00 | 4.2 |
| 650 | 2.44 | 0.20 | 0.03 | 0.98 | 6 | 0.11 | 1.3 |
| 650 | 2.46 | 0.20 | 0.05 | 0.95 | 2 | 0.11 | 1.6 |
| 650 | 2.40 | 0.19 | 0.01 | 0.99 | 9 | 0.09 | 3.4 |
| 660 | 2.30 | 0.16 | 0.24 | 0.88 | 4 | 0.00 | 4.4 |
| 660 | 2.30 | 0.17 | 0.24 | 1.00 | 9 | 0.00 | 4.0 |
| 660 | 2.40 | 0.18 | 0.25 | 0.91 | 6 | 0.00 | 4.6 |
| 660 | 2.07 | 0.20 | 0.06 | 0.99 | 4 | 0.12 | 1.1 |
| 660 | 2.30 | 0.18 | 0.22 | 0.99 | 8 | 0.00 | 3.9 |
| 660 | 2.30 | 0.18 | 0.18 | 0.94 | 18 | 0.00 | 4.7 |
| 660 | 2.20 | 0.17 | 0.17 | 1.02 | 27 | 0.00 | 4.3 |
| 660 | 2.20 | 0.17 | 0.06 | 0.99 | 53 | 0.00 | 5.5 |
| 660 | 2.18 | 0.21 | 0.04 | 1.01 | 6 | 0.13 | 0.6 |
| 660 | 2.40 | 0.17 | 0.00 | 1.01 | 75 | 0.00 | 88.0 |
| 660 | 2.23 | 0.21 | 0.22 | 1.00 | 10 | 0.01 | 4.4 |
| 660 | 2.26 | 0.21 | 0.25 | 0.86 | 10 | 0.01 | 4.7 |
| 660 | 2.15 | 0.20 | 0.12 | 0.98 | 5 | 0.04 | 2.3 |
| 680 | 2.04 | 0.20 | 0.07 | 0.96 | 4 | 0.14 | 1.0 |
| 680 | 2.30 | 0.17 | 0.20 | 0.96 | 45 | 0.00 | 6.9 |
| 680 | 2.39 | 0.19 | 0.01 | 0.95 | 14 | 0.18 | 5.0 |
| 680 | 2.30 | 0.18 | 0.26 | 1.00 | 18 | 0.00 | 5.4 |
| 680 | 2.48 | 0.20 | 0.07 | 0.98 | 5 | 0.17 | 2.1 |
| 680 | 2.30 | 0.16 | 0.31 | 0.90 | 6 | 0.00 | 5.4 |
| 680 | 2.30 | 0.17 | 0.29 | 0.97 | 9 | 0.00 | 4.7 |
| 680 | 2.40 | 0.18 | 0.31 | 0.90 | 5 | 0.00 | 5.2 |
| 680 | 2.48 | 0.20 | 0.01 | 1.03 | 16 | 0.16 | 6.9 |
| 680 | 2.20 | 0.17 | 0.18 | 1.01 | 49 | 0.00 | 6.4 |
| 680 | 2.30 | 0.21 | 0.29 | 0.87 | 20 | 0.01 | 5.9 |
| 680 | 2.21 | 0.20 | 0.20 | 1.02 | 52 | 0.00 | 6.3 |
| 680 | 2.40 | 0.18 | 0.00 | 1.03 | 96 | 0.00 | 97.3 |
| 680 | 2.23 | 0.21 | 0.05 | 1.01 | 10 | 0.16 | 0.8 |
| 680 | 2.20 | 0.17 | 0.06 | 0.97 | 73 | 0.00 | 8.1 |
| 680 | 2.18 | 0.21 | 0.13 | 1.00 | 7 | 0.05 | 2.0 |
| 680 | 2.45 | 0.20 | 0.04 | 0.99 | 10 | 0.18 | 3.0 |
| 680 | 2.16 | 0.21 | 0.24 | 0.98 | 22 | 0.02 | 5.3 |
| 700 | 2.30 | 0.17 | 0.21 | 0.96 | 82 | 0.00 | 9.4 |
| 700 | 2.28 | 0.21 | 0.31 | 0.87 | 39 | 0.02 | 8.5 |
| 700 | 2.13 | 0.20 | 0.10 | 1.00 | 5 | 0.17 | 1.0 |
| 700 | 2.30 | 0.17 | 0.28 | 1.01 | 39 | 0.00 | 7.3 |
| 700 | 2.22 | 0.21 | 0.26 | 1.01 | 24 | 0.03 | 5.4 |
| 700 | 2.40 | 0.17 | 0.00 | 1.02 | 113 | 0.00 | 93.4 |
| 700 | 2.20 | 0.17 | 0.18 | 1.02 | 73 | 0.00 | 7.8 |
| 700 | 2.20 | 0.17 | 0.07 | 0.98 | 97 | 0.00 | 11.2 |
| 700 | 2.40 | 0.17 | 0.36 | 0.96 | 6 | 0.00 | 6.1 |
| 700 | 2.25 | 0.21 | 0.05 | 1.02 | 15 | 0.23 | 2.2 |
| 700 | 2.23 | 0.21 | 0.15 | 1.01 | 10 | 0.08 | 2.0 |
| 700 | 2.30 | 0.18 | 0.39 | 0.94 | 8 | 0.00 | 6.7 |
| 700 | 2.40 | 0.15 | 0.37 | 0.94 | 13 | 0.00 | 7.4 |
| 710 | 2.21 | 0.20 | 0.21 | 1.03 | 111 | 0.00 | 10.2 |
| 710 | 2.48 | 0.20 | 0.04 | 1.01 | 25 | 0.21 | 6.3 |
| 710 | 2.47 | 0.20 | 0.01 | 1.03 | 30 | 0.20 | 14.6 |
| 710 | 2.46 | 0.19 | 0.01 | 1.01 | 25 | 0.28 | 7.6 |
| 710 | 2.50 | 0.20 | 0.08 | 0.99 | 20 | 0.20 | 3.7 |
| 720 | 2.20 | 0.17 | 0.18 | 1.01 | 110 | 0.00 | 9.7 |
| 720 | 2.30 | 0.16 | 0.42 | 1.01 | 18 | 0.00 | 9.3 |
| 720 | 2.30 | 0.17 | 0.00 | 0.99 | 149 | 0.00 | 95.6 |
| 720 | 2.20 | 0.17 | 0.07 | 0.97 | 134 | 0.00 | 16.4 |
| 720 | 2.22 | 0.21 | 0.15 | 1.01 | 23 | 0.11 | 1.9 |
| 720 | 2.40 | 0.15 | 0.42 | 0.96 | 29 | 0.00 | 10.2 |
| 720 | 2.25 | 0.21 | 0.33 | 0.86 | 113 | 0.02 | 12.0 |
| 720 | 2.30 | 0.17 | 0.29 | 1.00 | 77 | 0.00 | 12.4 |
| 720 | 2.40 | 0.18 | 0.44 | 0.93 | 15 | 0.00 | 10.5 |
| 720 | 2.28 | 0.21 | 0.05 | 1.04 | 23 | 0.30 | 3.3 |
| 720 | 2.24 | 0.21 | 0.11 | 1.03 | 23 | 0.19 | 1.5 |
| 720 | 2.26 | 0.21 | 0.27 | 1.01 | 40 | 0.04 | 6.9 |
| 720 | 2.30 | 0.17 | 0.21 | 0.93 | 121 | 0.00 | 13.0 |

TABLE 1-continued

Casting temperature, composition and corrosion rates for the permanent mold cast medallions included in this investigation.

| Temp. [° C.] | Al [weight %] | Zn [weight %] | Mn [weight %] | Si [weight %] | Fe [ppm] | RE [weight %] | Corrosion rate [MCD] |
|---|---|---|---|---|---|---|---|
| 740 | 2.30 | 0.17 | 0.44 | 0.97 | 40 | 0.00 | 13.9 |
| 740 | 2.30 | 0.17 | 0.21 | 0.94 | 155 | 0.00 | 18.9 |
| 740 | 2.20 | 0.16 | 0.06 | 0.94 | 181 | 0.00 | 24.5 |
| 740 | 2.30 | 0.17 | 0.30 | 1.13 | 122 | 0.00 | 16.9 |
| 740 | 2.30 | 0.17 | 0.18 | 1.00 | 135 | 0.00 | 13.0 |
| 740 | 2.30 | 0.17 | 0.00 | 0.99 | 189 | 0.00 | 69.1 |
| 760 | 2.30 | 0.17 | 0.18 | 1.00 | 189 | 0.00 | 19.6 |
| 760 | 2.40 | 0.17 | 0.00 | 1.01 | 243 | 0.00 | 60.8 |
| 760 | 2.30 | 0.17 | 0.06 | 0.97 | 246 | 0.00 | 26.4 |
| 760 | 2.30 | 0.17 | 0.22 | 0.93 | 219 | 0.00 | 22.2 |
| 760 | 2.30 | 0.17 | 0.30 | 1.01 | 150 | 0.00 | 19.8 |

Figure 2:
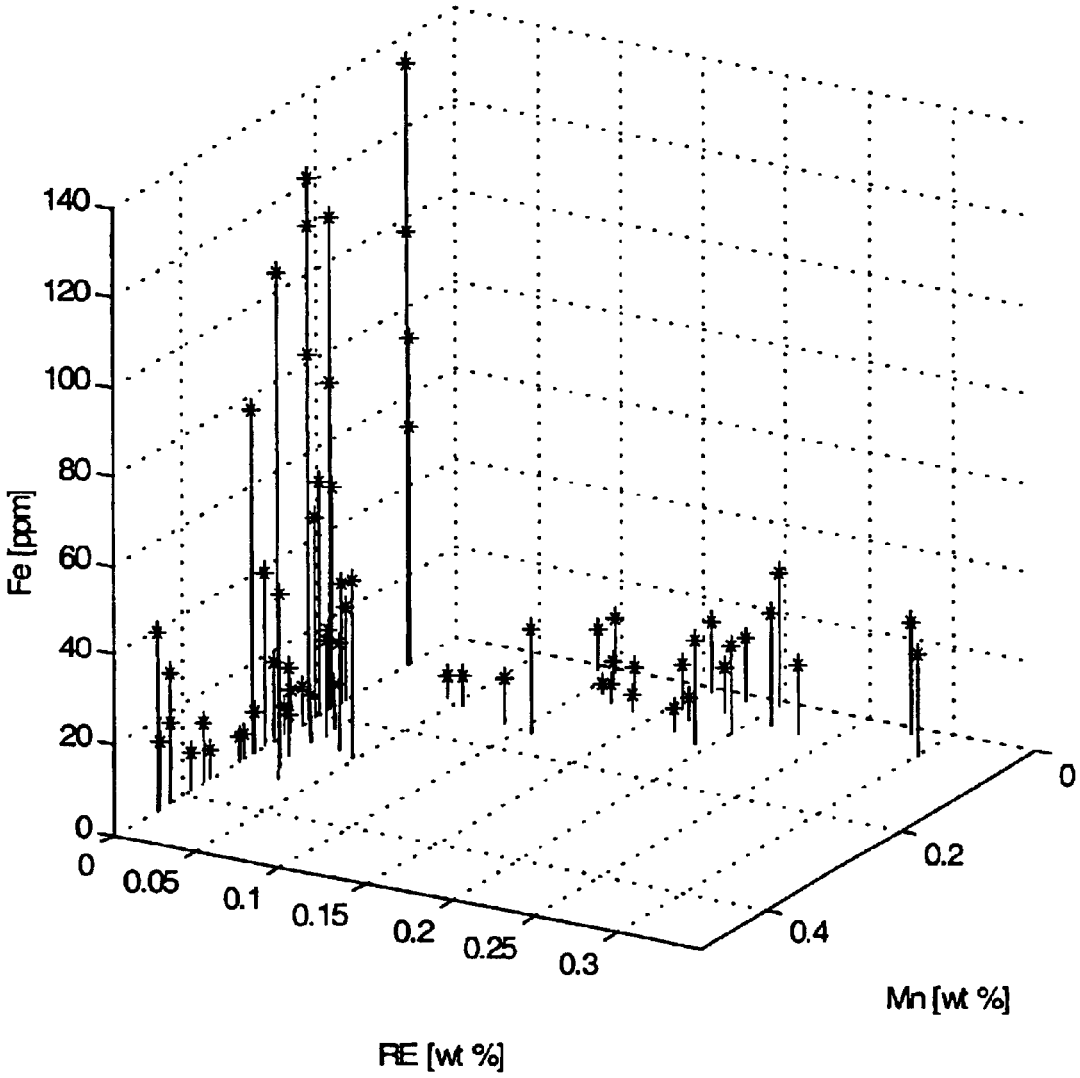
FIG. 2 shows the Fe content in the specimens analyzed in the test program.

The corresponding Fe contents are shown in FIG. 2. The figure includes data from different temperatures. It illustrates that all specimens containing more than 0.05 weight % RE have a Fe content below 40 ppm, while the specimens without RE may contain higher levels of Fe.

Figure 3:
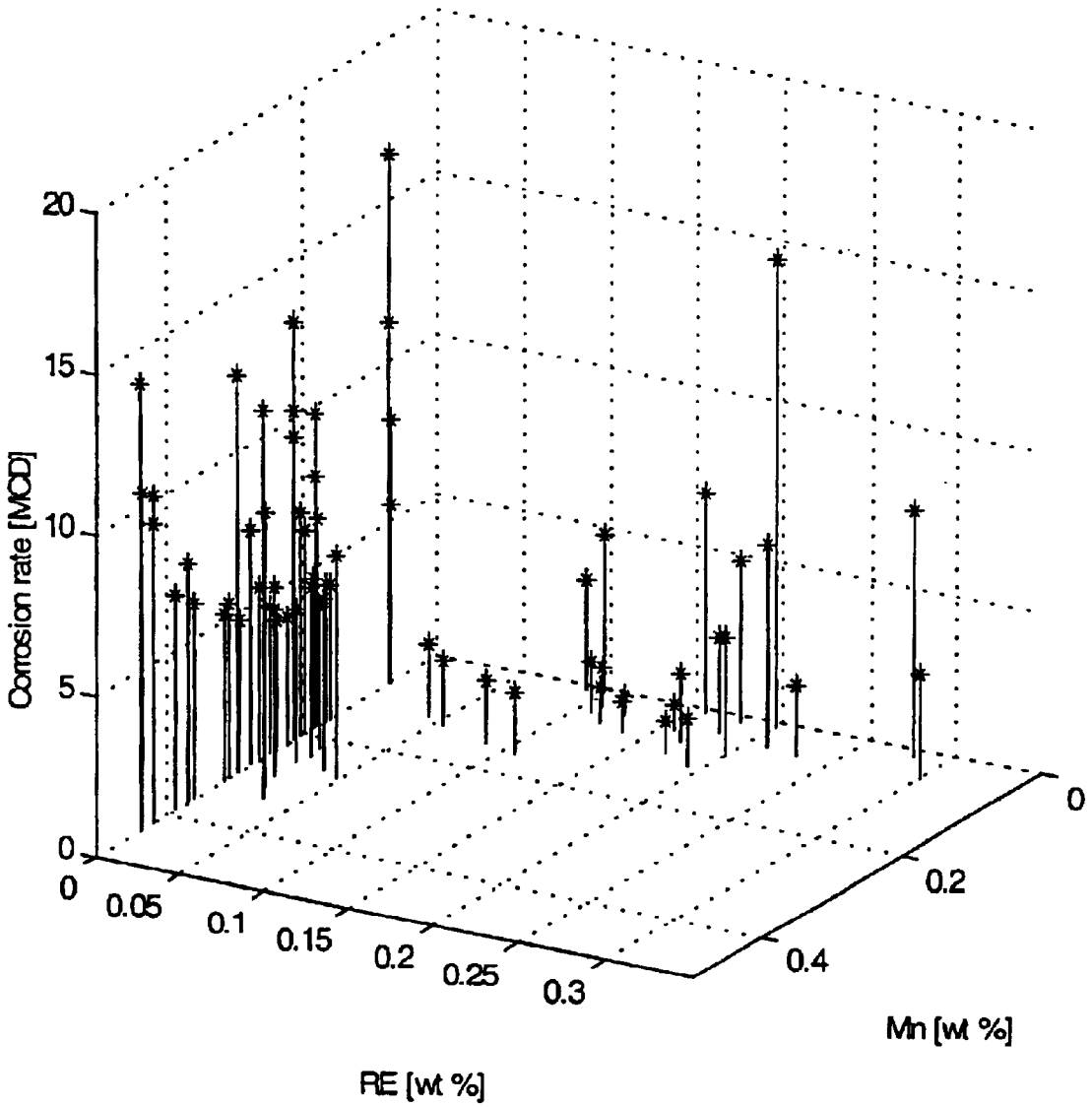
FIG. 3 shows corrosion rates (MCD=mg/cm$^2$day) of immersion tested of gravity cast disc samples versus RE and Mn content of the investigated specimens.

The corrosion rates are also given in Tables 1 and 2. The corrosion rates are illustrated vs. Mn and RE contents in FIG. 3. The corrosion rate is at a minimum for compositions with a Mn content between 0.05 and 0.2 weight %, and a RE content above 0.05 weight %. Comparing FIGS. 2 and 3 reveals that there is no direct correlation between the Fe content and the corrosion rates, also the content of Mn and RE has a significant influence.

Figure 4:
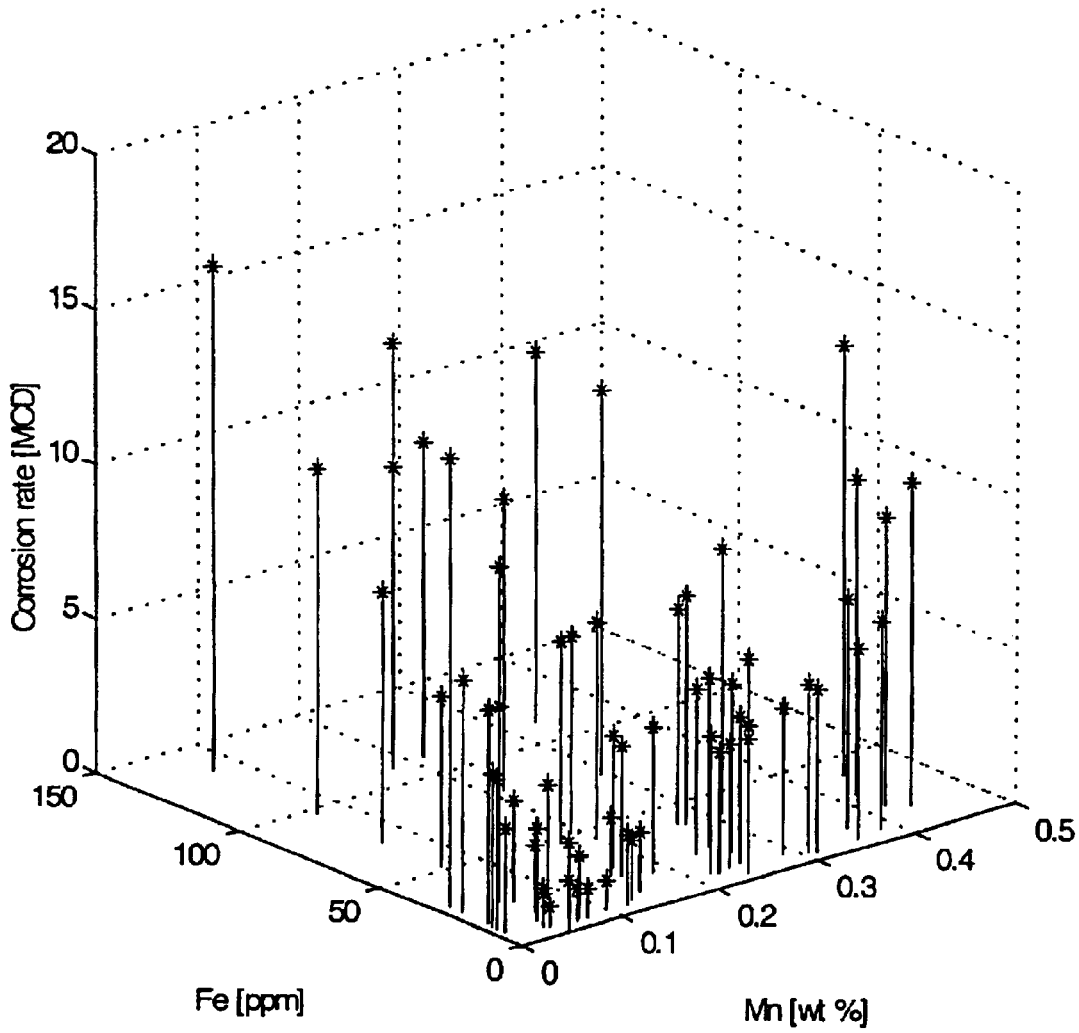
FIG. 4 shows corrosion rates versus Mn and Fe content of the investigated specimens. The results are from 72 hours immersion tests of gravity cast disc samples.
Figure 5:
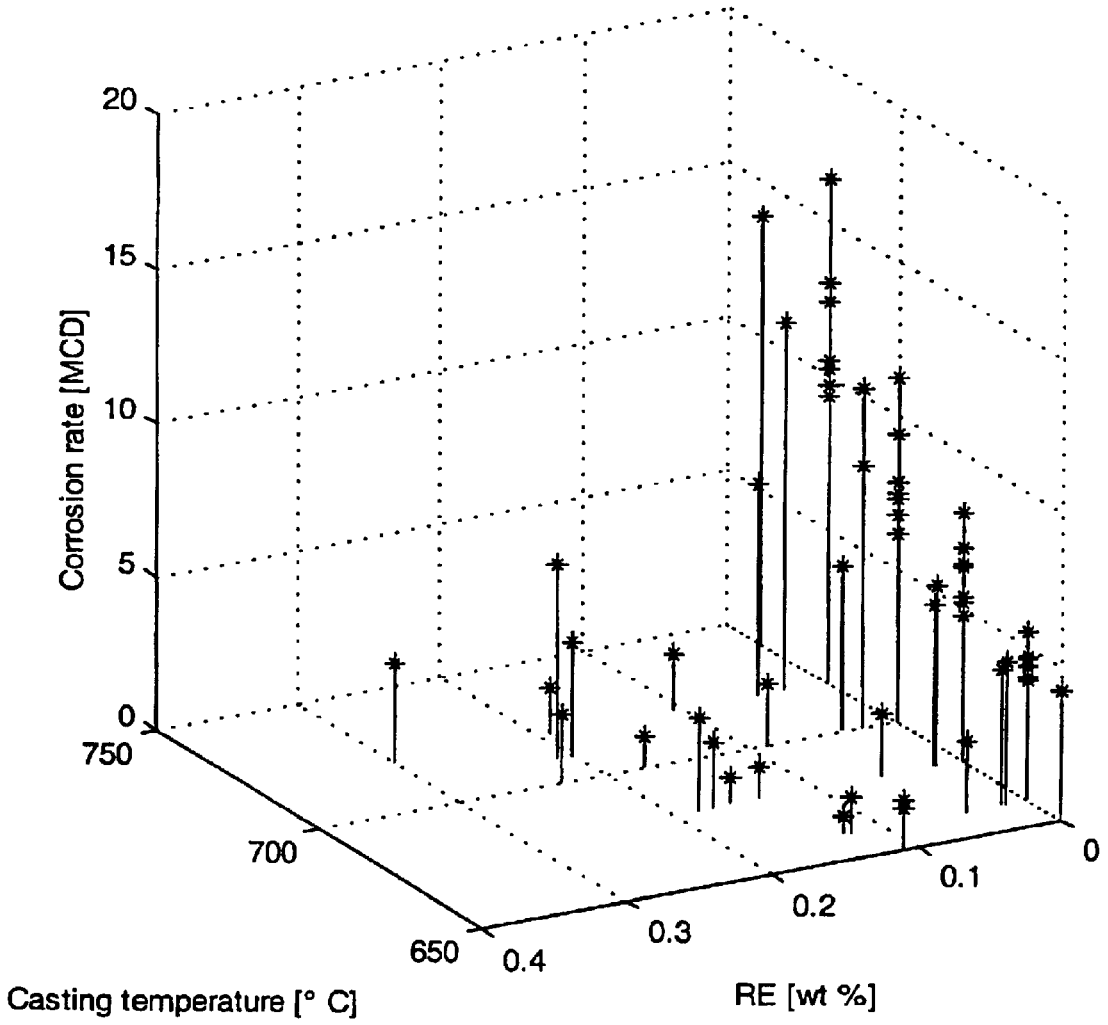
FIG. 5 shows corrosion rates versus RE content and casting temperature for the gravity cast disc samples containing minimum 0.045 weight % Mn.

This can be seen in FIG. 4, where the corrosion rates are plotted vs. the content of Mn and Fe, and the minimum is reached when both elements are at a low level. This is, however, not possible to obtain without the addition of other alloying elements, like the RE elements. Furthermore, the corrosion rates increase when the Mn content is below 0.05 weight %. Thus, the presence of a low level of Mn is necessary for an optimum effect. The effect of RE addition of increased temperature is unexpected. FIG. 5 presents corrosion rates vs. RE content and casting temperature for the gravity cast disc samples containing a minimum of 0.045 weight % Mn. Due to the increased solubility of Mn and Fe with increased temperature, increased temperature has a strong negative effect on the corrosion resistance of unmodified AS21. With the addition of RE elements, the equilibrium levels of Mn and Fe are strongly reduced also at higher temperatures, thereby significantly reducing the corrosion rates.

EXAMPLE 2

Figure 6:
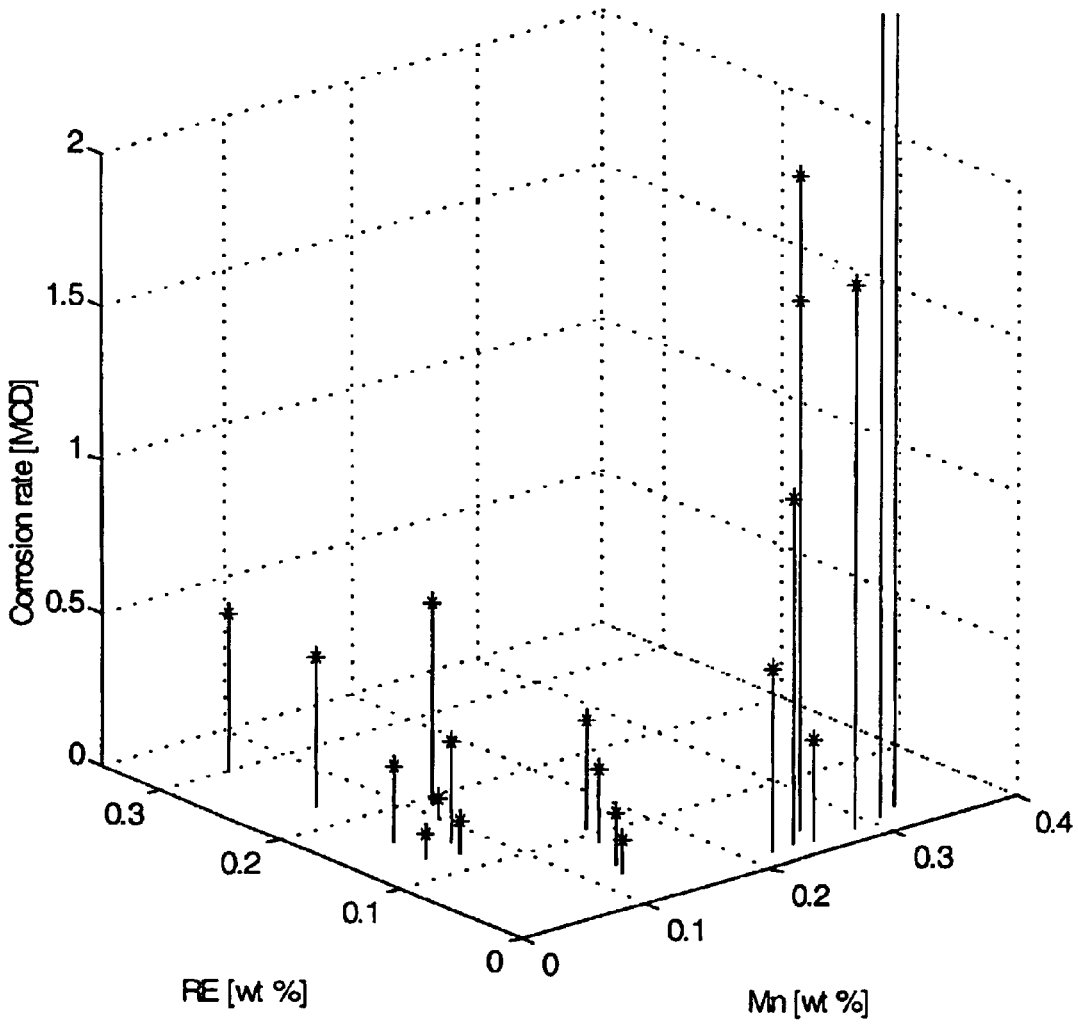
FIG. 6 shows corrosion rates versus Mn and RE content of the investigated die cast plates. In this investigation the Mn and the RE contents were varied in the range 0.05–0.35 weight %.
Figure 7:
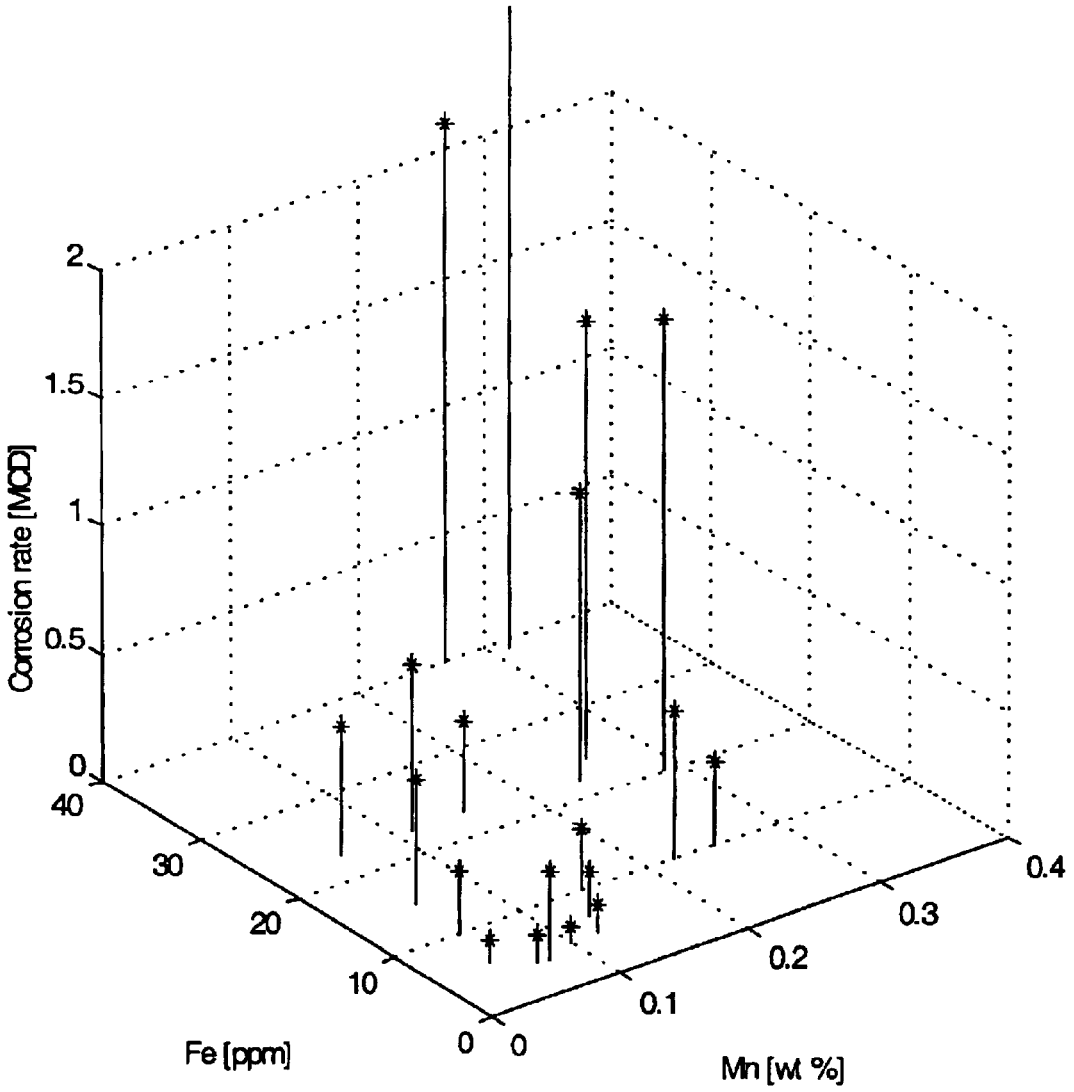
FIG. 7 shows corrosion rates for the die cast plates, tested in salt spray for 240 hours according to ASTM B117, versus Mn and Fe content. The trends as observed in the immersion tests of the gravity cast disc samples are also found here.

The alloy AS21 is produced for application as a die casting alloy. A selected set of compositions, as shown in Table 2, was therefore die cast into test plates, and tested in salt-spray according to ASTM standard no. B117-90. The corrosion results are included in Table 2 and are shown in FIGS. 6 and 7. There is correspondence between the corrosion rates determined for die cast plates and gravity cast disc samples. An optimum composition range is found for compositions with 0.05–0.2 weight % RE, and 0.05–0.2 weight % Mn.

TABLE 2

Casting temperature, composition and corrosion rates for the die cast test plates included in this investigation. The corrosion rates are determined after 240 hours exposure in salt-spray.

| Temp. [° C.] | Al [weight %] | Zn [weight %] | Mn [weight %] | Si [weight %] | Fe [ppm] | RE [weight %] | Corrosion rate [MCD] |
|---|---|---|---|---|---|---|---|
| 720 | 2.25 | 0.21 | 0.33 | 0.86 | 113 | 0.02 | 13.6 |
| 700 | 2.28 | 0.21 | 0.31 | 0.87 | 39 | 0.02 | 4.5 |
| 680 | 2.30 | 0.21 | 0.29 | 0.87 | 20 | 0.01 | 1.8 |
| 660 | 2.26 | 0.21 | 0.25 | 0.86 | 10 | 0.01 | 0.3 |
| 720 | 2.26 | 0.21 | 0.27 | 1.01 | 40 | 0.04 | 2.1 |
| 700 | 2.22 | 0.21 | 0.26 | 1.01 | 24 | 0.03 | 1.7 |
| 680 | 2.16 | 0.21 | 0.24 | 0.98 | 22 | 0.02 | 1.1 |
| 660 | 2.23 | 0.21 | 0.22 | 1.00 | 10 | 0.01 | 0.6 |
| 720 | 2.22 | 0.21 | 0.15 | 1.01 | 23 | 0.11 | 0.4 |
| 700 | 2.23 | 0.21 | 0.15 | 1.01 | 10 | 0.08 | 0.2 |
| 680 | 2.18 | 0.21 | 0.13 | 1.00 | 7 | 0.05 | 0.2 |
| 660 | 2.15 | 0.20 | 0.12 | 0.98 | 5 | 0.04 | 0.1 |
| 720 | 2.24 | 0.21 | 0.11 | 1.03 | 23 | 0.19 | 0.7 |
| 700 | 2.13 | 0.20 | 0.10 | 1.00 | 5 | 0.17 | 0.0 |
| 680 | 2.04 | 0.20 | 0.07 | 0.96 | 4 | 0.14 | 0.3 |

TABLE 2-continued

Casting temperature, composition and corrosion rates for the die cast test plates included in this investigation. The corrosion rates are determined after 240 hours exposure in salt-spray.

| Temp. [° C.] | Al [weight %] | Zn [weight %] | Mn [weight %] | Si [weight %] | Fe [ppm] | RE [weight %] | Corrosion rate [MCD] |
|---|---|---|---|---|---|---|---|
| 660 | 2.07 | 0.20 | 0.06 | 0.99 | 4 | 0.12 | 0.1 |
| 720 | 2.28 | 0.21 | 0.05 | 1.04 | 23 | 0.30 | 0.5 |
| 700 | 2.25 | 0.21 | 0.05 | 1.02 | 15 | 0.23 | 0.5 |
| 680 | 2.23 | 0.21 | 0.05 | 1.01 | 10 | 0.16 | 0.2 |
| 660 | 2.18 | 0.21 | 0.04 | 1.01 | 6 | 0.13 | 0.0 |

In addition to die casting of test plates, large engine parts with casting weights of 20 kg have been cast from the alloy. In comparison with the unmodified AS21, the castability was not significantly affected.

The mechanical properties of the alloys are governed by the content of Al, Si, and Zn, and is not significantly affected by the modification by addition of RE elements.

EXAMPLE 3

Two melts, each of 150 kg Mg alloy were produced in the foundry lab. Each of the melts were produced with 1.5% Al, 1.0% Si and 0.2% Zn. One melt was produced with 0.4% added Mn, the other with 0.3% RE+0.1% Mn. The alloys were produced at 740° C., thereafter stabilised at 680° C. for at least 1 hour before casting of permanent mould cast disc samples and 3 mm die cast test plates. Each melt was further alloyed with super purity Al in steps of 1% to cover the Al-range given in claim 1. This alloying was done at 680° C., and the alloys were stabilised for at least 1 hour before further casting. The chemical analysis of each composition is shown in Table 3. The analysis was carried out by spark emission spectrograph, the RE-elements by ICP-AES.

TABLE 3

Chemical compositions of the investigated specimens

| Specimen I.D | Al [wt %] | Zn [wt %] | Mn [wt %] | Si [wt %] | Fe [wt %] | Cu [wt %] | Ni [wt %] | Be [ppm] | Sum RE [wt %] |
|---|---|---|---|---|---|---|---|---|---|
| U-1 | 1.388 | 0.201 | 0.269 | 0.9334 | 0.0018 | 0.0002 | 0.0002 | 0.9 | 0 |
| U-2 | 2.322 | 0.208 | 0.258 | 0.9108 | 0.0027 | 0.0002 | 0.0002 | 0.9 | 0 |
| U-3 | 3.203 | 0.205 | 0.256 | 0.9065 | 0.0034 | 0.0002 | 0.0002 | 0.9 | 0 |
| U-4 | 4.092 | 0.207 | 0.264 | 0.9143 | 0.0047 | 0.0002 | 0.0002 | 0.9 | 0 |
| U-5 | 4.974 | 0.205 | 0.286 | 0.9248 | 0.0056 | 0.0002 | 0.0002 | 0.9 | 0 |
| M-1 | 1.490 | 0.202 | 0.074 | 0.8880 | 0.0022 | 0.0002 | 0.0002 | 0.9 | 0.16 |
| M-2 | 2.544 | 0.207 | 0.071 | 0.9065 | 0.0029 | 0.0002 | 0.0002 | 0.9 | 0.15 |
| M-3 | 3.463 | 0.204 | 0.070 | 0.8835 | 0.0041 | 0.0002 | 0.0002 | 0.9 | 0.16 |
| M-4 | 4.421 | 0.206 | 0.070 | 0.9103 | 0.0048 | 0.0002 | 0.0002 | 0.9 | 0.16 |
| M-5 | 5.349 | 0.210 | 0.087 | 0.9323 | 0.0123 | 0.0002 | 0.0002 | 2.8 | 0.2 |

Figure 8:
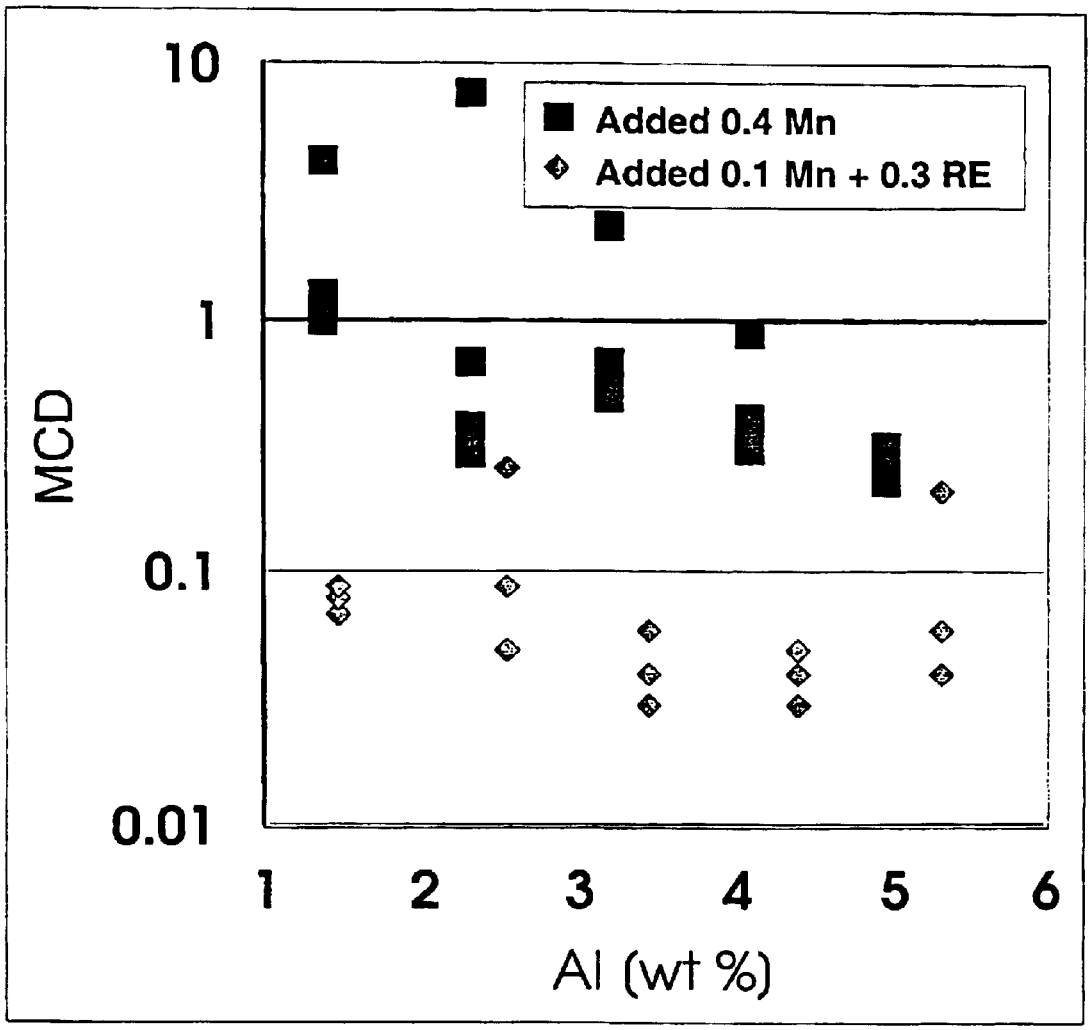
FIG. 8 shows the individual corrosion test results versus Al-content for two series of alloys.
Figure 9:
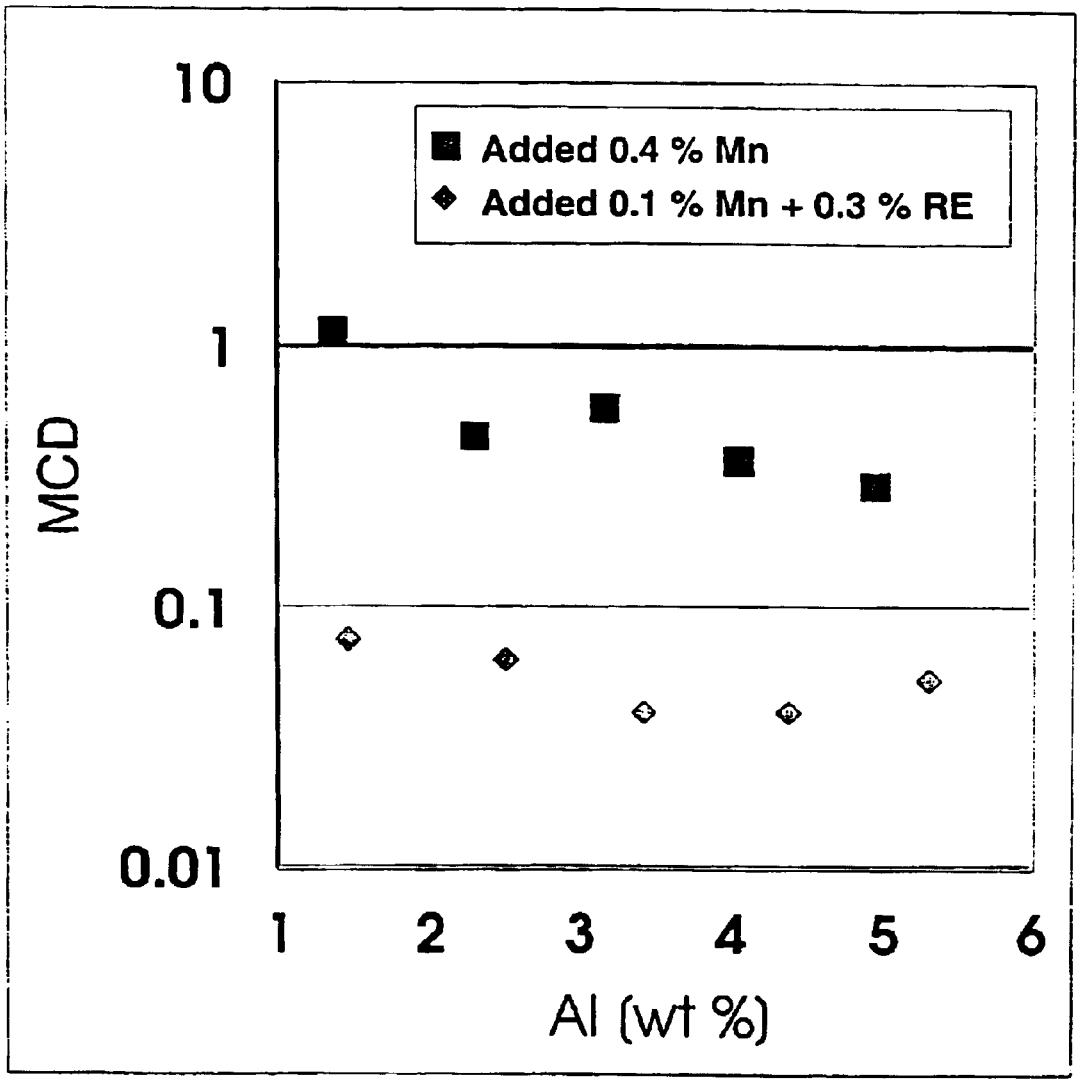
FIG. 9 shows mean values of corrosion test results versus Al-content for two series of alloys when the outliers are excluded.

Four die cast lest plates from each composition were tested in salt-spray for 10 days according to ASTM B117. The results are shown in Table 4, and in FIG. 8. For some of the compositions there were single results diverging significantly from the rest of the same series. The average results without the outliers are shown in FIG. 9. The outliers are here defined as single results lying more that 4× standard deviation outside the average of the other parallels. These are also marked in Table 4.

TABLE 4

Corrosion test results in MCD $$\text{MCD}\frac{\text{mg weight loss}}{(\text{cm}^2 \times \text{day})}.$$

Outliers are marked with bold italic

| Specimen I.D. | MCD | MCD | MCD | MCD | Mean | Std. Dev. | Mean ex outlier | Std dev. ex outlier |
|---|---|---|---|---|---|---|---|---|
| U-1 | 1 | 1.2 | 1.3 | ***4.3*** | 2.0 | 1.6 | 1.17 | 0.12 |
| U-2 | 0.3 | 0.4 | 0.7 | ***7.8*** | 2.3 | 3.7 | 0.47 | 0.17 |
| U-3 | 0.51 | 0.6 | 0.7 | ***2.4*** | 1.1 | 0.9 | 0.60 | 0.08 |
| U-4 | 0.32 | 0.38 | 0.42 | *0.9* | 0.5 | 0.3 | 0.37 | 0.04 |
| U-5 | 0.24 | 0.31 | 0.31 | 0.33 | 0.3 | 0.04 | 0.30 | 0.03 |
| M-1 | 0.07 | 0.07 | 0.08 | 0.09 | 0.08 | 0.01 | 0.08 | 0.01 |

TABLE 4-continued

Corrosion test results in MCD $$MCD \frac{mg\ weight\ loss}{(cm^2 \times day)}.$$

Outliers are marked with bold italic

| Specimen I.D. | MCD | MCD | MCD | MCD | Mean | Std. Dev. | Mean ex outlier | Std dev. ex outlier |
|---|---|---|---|---|---|---|---|---|
| M-2 | 0.05 | 0.05 | 0.09 | ***0.26*** | 0.11 | 0.1 | 0.06 | 0.02 |
| M-3 | 0.03 | 0.03 | 0.04 | 0.06 | 0.04 | 0.01 | 0.04 | 0.01 |
| M-4 | 0.03 | 0.04 | 0.04 | 0.05 | 0.04 | 0.01 | 0.04 | 0.01 |
| M-5 | 0.04 | 0.06 | 0.06 | ***0.21*** | 0.09 | 0.08 | 0.05 | 0.01 |

The compositions of the two series are very similar, except for the Mn and the RE content. Even though super purity Al was used, the Fe-content is increasing together with the Al-addition. This Fe-pick up was fairly similar for the two series, except at the highest Al-level, where the RE-modified alloy reached 123 ppm Fe, compared to 56 ppm in the unmodified. For the series without RE, the corrosion rates decreases with increasing Al, in spite of the increasing Fe. For the series modified with RE, the corrosion rates are significantly lower, and no obvious trends with variation of Al and Fe can be seen. The results clearly show that the corrosion rates of the RE-modified alloy is significantly lower than for the unmodified alloy through the whole Al-composition range. For several compositions there are outliers with significantly higher corrosion rates than the other specimens from the same series. The background for these high individual results are not investigated. These outliers are not influencing on the conclusion of this investigation.Thus, the modification of AS-alloys by substituting some of the Mn with RE-elements has a significant positive effect on the corrosion resistance over the whole composition range of 1.5–5% Al.

The corrosion resistance of magnesium-aluminium-silicon based alloys is significantly improved by the addition of RE elements by:

1) Reducing the solubility of Mn

2) Reducing the solubility of Fe

3) Modifying the corrosion behavior by the presence of RE. The presence of small amounts of Mn (above 0.01 weight %) is necessary for an optimum effect of the modification.

This positive effect of RE elements on corrosion resistance will also apply for other levels of Si and Zn in the AS-alloys.

What is claimed is:

1. A magnesium based alloy with improved corrosion resistance, consisting essentially of 1.5–5 weight % Al, 0.6–1.4 weight % Si, 0.01–0.6 weight % Mn, 0.01–0.4 weight % RE, up to 0.5 weight % Zn, the balance being Mg and impurities.

2. The magnesium alloy according to claim 1, wherein the Zn content is in the range 0.1–0.3 weight %.

3. The magnesium alloy according to claim 1, wherein the Mn content is in the range 0.01–0.3 weight %.

4. The magnesium alloy according to claim 1, wherein the rare earth elements are Misch metal.

5. The magnesium alloy according to claim 1, consisting essentially of 1.9–2.5 weight % Al, 0.7–1.2 weight % Si, 0.1 5–0.25 weight % Zn, 0.01–0.3 weight % RE and 0.01–0.2 weight % Mn, the balance being Mg and impurities.

6. A method of improving the corrosion resistance of magnesium-aluminium-silicon alloys, which comprises adding Mn to the alloy in order to reduce Fe impurities, and adding a small amount of RE to keep both Mn and Fe at a low level, resulting in an alloy with improved corrosion resistance consisting essentially of Mg, Al, Si, Mn and RE.

7. The method according to claim 6, wherein the Mn content is kept above 0.01 weight %.

8. The method according to claim 6, wherein the RE content is kept in the range 0.01–0.4 weight %.

* * * * *